US008123472B2

(12) United States Patent
Redgwell

(10) Patent No.: US 8,123,472 B2
(45) Date of Patent: Feb. 28, 2012

(54) UNISON RING ASSEMBLY FOR AN AXIAL COMPRESSOR CASING

(75) Inventor: Paul Redgwell, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/934,115

(22) PCT Filed: Feb. 25, 2009

(86) PCT No.: PCT/EP2009/052188

§ 371 (c)(1),
(2), (4) Date: Sep. 23, 2010

(87) PCT Pub. No.: WO2009/121665

PCT Pub. Date: Oct. 8, 2009

(65) Prior Publication Data

US 2011/0020120 A1 Jan. 27, 2011

(30) Foreign Application Priority Data

Mar. 31, 2008 (EP) ..... 08006509

(51) Int. Cl.
*F04D 29/56* (2006.01)

(52) U.S. Cl. ..... 415/160; 415/155

(58) Field of Classification Search ..... 415/126, 415/127, 155, 160

See application file for complete search history.

(56) References Cited

U.S. PATENT DOCUMENTS

| | | | | |
|---|---|---|---|---|
| 4,430,043 | A * | 2/1984 | Knight et al. | 415/159 |
| 4,812,106 | A * | 3/1989 | Purgavie | 415/139 |
| 4,826,399 | A * | 5/1989 | Perez | 415/150 |
| 4,925,364 | A * | 5/1990 | Das | 415/150 |
| 5,387,080 | A | 2/1995 | Bouhennicha et al. | |
| 5,601,401 | A * | 2/1997 | Matheny et al. | 415/160 |
| 5,700,129 | A * | 12/1997 | Kocian | 415/138 |
| 6,884,025 | B2 * | 4/2005 | Pickens et al. | 415/160 |
| 7,198,454 | B2 * | 4/2007 | Evans | 415/12 |
| 2006/0193720 | A1 | 8/2006 | Bromann | |
| 2007/0183889 | A1 | 8/2007 | Bromann | |

FOREIGN PATENT DOCUMENTS

| | | |
|---|---|---|
| EP | 0741247 A2 | 11/1996 |
| EP | 1403467 A2 | 3/2004 |
| EP | 1818509 A1 | 8/2007 |

* cited by examiner

*Primary Examiner* — Edward Look
*Assistant Examiner* — Sean J Younger

(57) ABSTRACT

A unison ring assembly for an axial compressor casing is provided. The unison ring assembly includes a unison ring and at least three unison ring supports being radial inwardly and equally spaced arranged along a circumference of the unison ring, wherein each unison ring support has a unison ring bracket attached to the unison ring. Further, the unison ring assembly includes a slide bearing to be sliding along a slide face of an outer surface of the compressor casing and a resilient member being arranged between and coupled to the slide bearing and the unison ring bracket such that the unison ring is rotatable around the compressor casing by sliding the slide bearing along the slide face and to be centered free of clearance about the compressor casing. The resilient member is adapted to accommodate radial displacement of the compressor casing.

15 Claims, 2 Drawing Sheets

UNISON RING ASSEMBLY FOR AN AXIAL COMPRESSOR CASING

CROSS REFERENCE TO RELATED APPLICATIONS

This application is the U.S. National Stage of International Application No. PCT/EP2009/052188 filed Feb. 25, 2009, and claims the benefit thereof. The International Application claims the benefits of European Patent Application No. 08006509.7 EP filed Mar. 31, 2008. All of the applications are incorporated by reference herein in their entirety.

FIELD OF INVENTION

The invention relates to a unison ring assembly for an axial compressor, an axial compressor comprising the unison ring assembly, and a method for mounting the unison ring assembly on the axial compressor casing.

BACKGROUND OF INVENTION

A gas turbine comprises a turbine and a compressor driven by the turbine. In particular, when the gas turbine is provided for a gas-steam power plant, the compressor is of the axial flow type. Commonly, the gas turbine is subjected to varying operating conditions resulting in different aerodynamic flow conditions within the compressor. In order to adapt the compressor performance to different operating demands, it is known to provide the compressor with variable guide vanes. The variable guide vanes are to be pivoted about their longitudinal axis in order to adjust their angle of attack.

Each variable guide vane is provided with a journal at its root, wherein the journal is pivot-mounted in a through hole in the compressor casing. The journal is accessible from outside the compressor casing and comprises a lever to be actuated for pivoting the variable guide vane. All levers are coupled by means of a unison ring arranged concentrically around the compressor casing. The rotation of the unison ring actuates each of the variable guide vane levers simultaneously to achieve a corresponding rotational setting of each variable guide vane within the compressor casing.

Further, the unison ring is provided with slide bearings supported on the compressor casing such that the slide bearings slide in circumference direction on the outer surface of the compressor casing, when the unison ring is turned.

The compressor casing is interiorly contacted by hot gas and therefore heated up and thermally expanded. In particular, when the compressor is subjected to transient operating conditions, the thermal expansion of the compressor is transient. If there is no accommodation of the thermal induced expansion between the compressor casing and the unison ring against the compressor casing, the unison ring would shrink into the expanding compressor casing and nip.

Providing a clearance between the unison ring slide bearing and the outer surface of the compressor casing results in a non-concentric and uneven unison ring movement of the unison ring relative to a casing diameter the unison ring is rotating about. This results in circumferential variations in positioning accuracy of each variable guide vane. Redundant unison ring movement is a result of the clearance between the unison ring slide bearings and the compressor casing surface they run on. Temperature induced expansion differences between the compressor casing and the unison ring result in running clearance variations. Currently, a design must provide sufficient clearance allowance between the unison ring slide bearing and the compressor casing to ensure nip of the unison ring will not occur during maximum temperature variations. By contrast an increased clearance will result in increased levels of non-concentric unison ring movement.

The restricting design consideration is during engine warn up when the compressor casing heats up rapidly relative to the unison ring and also during operation in low ambient temperatures. Clearance variation is also exasperated when factoring in machining tolerances of the assembled components and operational wear between the contacting components.

The clearance is set to ensure that the unison ring does not nip and become tight at extreme conditions. This means that for the nominal constant running condition the unison ring clearance is not optimal. Clearance between the slide bearings of the unison ring and their contact surface, the compressor casing, results in redundant movement when an external force is applied to rotate the unison ring about the compressor casing. This is because the unison ring needs to traverse the distance of the clearance in a vertical and horizontal movement until two slide bearings contact the compressor casing and the force is then transferred into rotation about the compressor casing.

Known turbines use cylindrical roller wheels at three equidistant points at the inside diameter of the unison ring. The rollers are made of a rubber compound which would accommodate some compression as the unison ring and the compressor casing experience differential growth. As an alternative it is known to calculate a clearance allowance for a best fit practice of components based on each compressor stage casing nominal operating temperature against a unison ring temperature of 15° C. and the tolerance stack of these components. This calculated diameter is then machined after the complete ring has been assembled but prior to attachment around the compressor casing. Another method adopted to achieve the calculated clearance is to add or remove shims under each bearing pad as an assembly process.

SUMMARY OF INVENTION

It is an object of the invention to provide a unison ring assembly for an axial compressor, an axial compressor comprising the unison ring assembly, a gas turbine comprising the axial compressor, and a method for mounting the unison ring assembly on the axial compressor casing, wherein the unison ring assembly is temperature and wear adjustable and therefore properly positionable around the compressor casing.

The unison ring assembly for an axial compressor casing according to the invention comprises an unison ring and at least three unison ring supports being radial inwardly and equally spaced arranged along the circumference of the unison ring, wherein each unison ring support comprises an unison ring bracket attached to the unison ring, a slide bearing to be sliding along a slide face of the outer surface of the compressor casing and a resilient member being arranged between and coupled to the slide bearing and the unison ring bracket, such that the unison ring is rotatable around the compressor casing by sliding the slide bearing along the slide face and to be centered free of clearance about the compressor casing, wherein the resilient member is adapted to accommodate radial displacement of the compressor casing.

The axial compressor according to the invention comprises a casing and the unison ring assembly.

The gas turbine according to the invention comprises the axial compressor.

The method for mounting a unison ring assembly on an axial compressor casing according to the invention comprises the steps: providing the unison ring assembly separate from an axial compressor casing comprising a slide face of the outer surface of the compressor casing; simultaneously compressing the resilient members of each unison ring support such that the slide bearings of every unison ring support define an inner diameter being at least equal or greater than the outer diameter of the slide face; shifting the unison ring assembly in axial direction of the compressor casing over the slide face; releasing the resilient members of each unison ring support such that the slide bearings abut on the slide face.

The exponential force required to compress the resilient member within the unison ring assembly results in ready accommodation of relatively small diametric differential between the compressor casing and the unison ring diameter while still opposing greater magnitudes of compression from the external drive faun that is required to rotate the unison ring.

When the unison ring is positioned about the compressor casing, the resilient members expand to effect contact of each of the slide bearings against the compressor casing. Than, the unison ring assembly is settled to accommodate a diametric variation resulting from machined tolerance and also wear at the contact slide faces of the sliding components. As the diametric differential between the unison ring and the compressor casing varies, the slide bearings are forced outwards by the expanding casing and slide out radially. The resilient members compress to absorb this movement and can expand again as expansion equilibrium is encountered between the unison ring and the compressor casing during steady state running.

By positioning three slide bearings equi-spaced around the unison ring, the result is an equalisation of the compression force relative to each other individual slide bearing. This in effect ensures that the unison ring is always positioned concentric to the inner diameter and therefore rotate concentrically about it. Further, the slide bearings offer minimal friction to enable the contacting surfaces to slide freely.

The positioning of three unison ring supports equi-spaced around the unison ring provides equalization of the compression form relative to each other individual unison ring support. This in effect will ensure that the unison ring is consistently positioned concentric to the casing diameter that it rotates about. Consistent concentric rotation of the unison ring about the compressor case diameter irrespective to the assembly components thermal growth or operational surface wear ensures each variable guide vane lever is actuated equally around the whole unison ring circumference. The maintained contact between the unison ring slipper pads and the compressor case eliminates any redundant movement of the unison ring.

Preferably, the slide bearing is profiled to match the outer diameter of the compressor casing. Therefore, even load distribution against the compressor casing is ensured. This assists minimal friction and even wear of the contacting surfaces.

Further, it is preferred that the resilient member comprises at least one slide pin having a first end supported at the unison bracket and a second end extending radial towards the centre of the unison ring together with an elastic element, which is arranged between the second end of the slide pin and the slide bearing.

The elastic material when compressed provides expansion to maintain constant contact of the slide bearing against the casing. Expansion of the elastic material will accommodate mechanical wear of the contact surfaces and initial machined tolerance variation of the unison ring assembly against the compressor casing. The elastic material components can also compress to accommodate the differential diameters of the expanding compressor casing relative to the unison ring. The elastic material exhibits a steeply exponential force requirement to compress offering the advantage that small ratios of compression caused by differential thermal expansions and manufacturing tolerances are readily accommodated whilst also resisting larger external unison ring driving forces.

The first end of the slide pin has preferably a smaller diameter than the second end of the slide pin thereby forming a stop, wherein the first end is fitted into a hole provided in the unison ring bracket, such that the stop abuts against the unison rig bracket.

Therefore, each slide bearing is free to slide radially on the slide pins. The slide bracket comprises the hole that the slide pin fit into. The sliding fit achieved between the hole and the slide pin enables the slide bearing to traverse in radial direction.

Preferably, the resilient member comprises two slide pins, each arranged together with the corresponding elastic member, wherein the slide pins are arranged side by side in axial direction of the unison ring.

Having two slide pins ensure the slide bearing can not rotate about its central axis.

It is preferred that the slide bearing comprises a first collar and a second collar, wherein the second end of the first slide pin and the first elastic element are embedded by the first collar, and the second end of the second slide pin and the second elastic element are embedded by the second collar.

The unison ring assembly comprises preferably raising means, adapted to raise the slide bearing towards the unison ring bracket thereby compressing the resilient means.

Preferably, the raising means comprises a web of the slide bearing being arranged between the first slide pin and the second slide pin, and a compression screw forming a bolted connection between the unison ring bracket and the slide bearing adapted to fix the slide bearing to the unison ring bracket as well as to lift off the slide bearing from the unison ring bracket.

The compression screw incorporated by the slide bearing facilitates the unison ring assembly by initially compressing and clamping together the resilient member to offer exaggerated diametric clearance. Once the complete unison ring has been positioned about the compressor case each compression screw is loosened.

Preferably, the web comprises a threaded centre hole to engage the compression screw to facilitate compression of the resilient member for assembly.

BRIEF DESCRIPTION OF THE DRAWINGS

In the following the invention is explained on the basis of preferred embodiments with reference to the drawings. In the drawings.

DETAILED DESCRIPTION OF INVENTION

Figure 1:
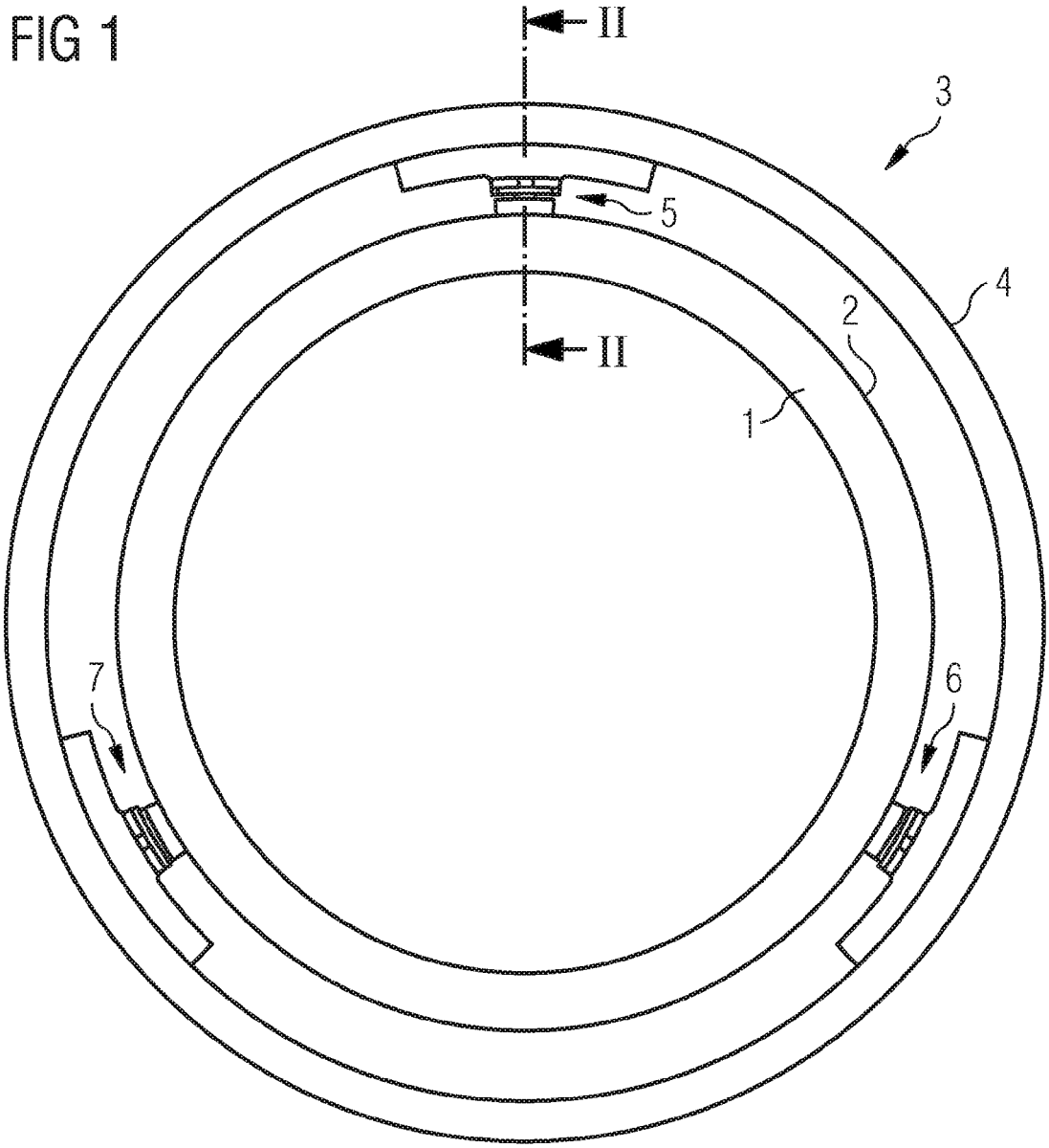
FIG. 1 shows a cross section of an embodiment of a compressor casing with a unison ring assembly mounted thereon according to the invention.
Figure 2:
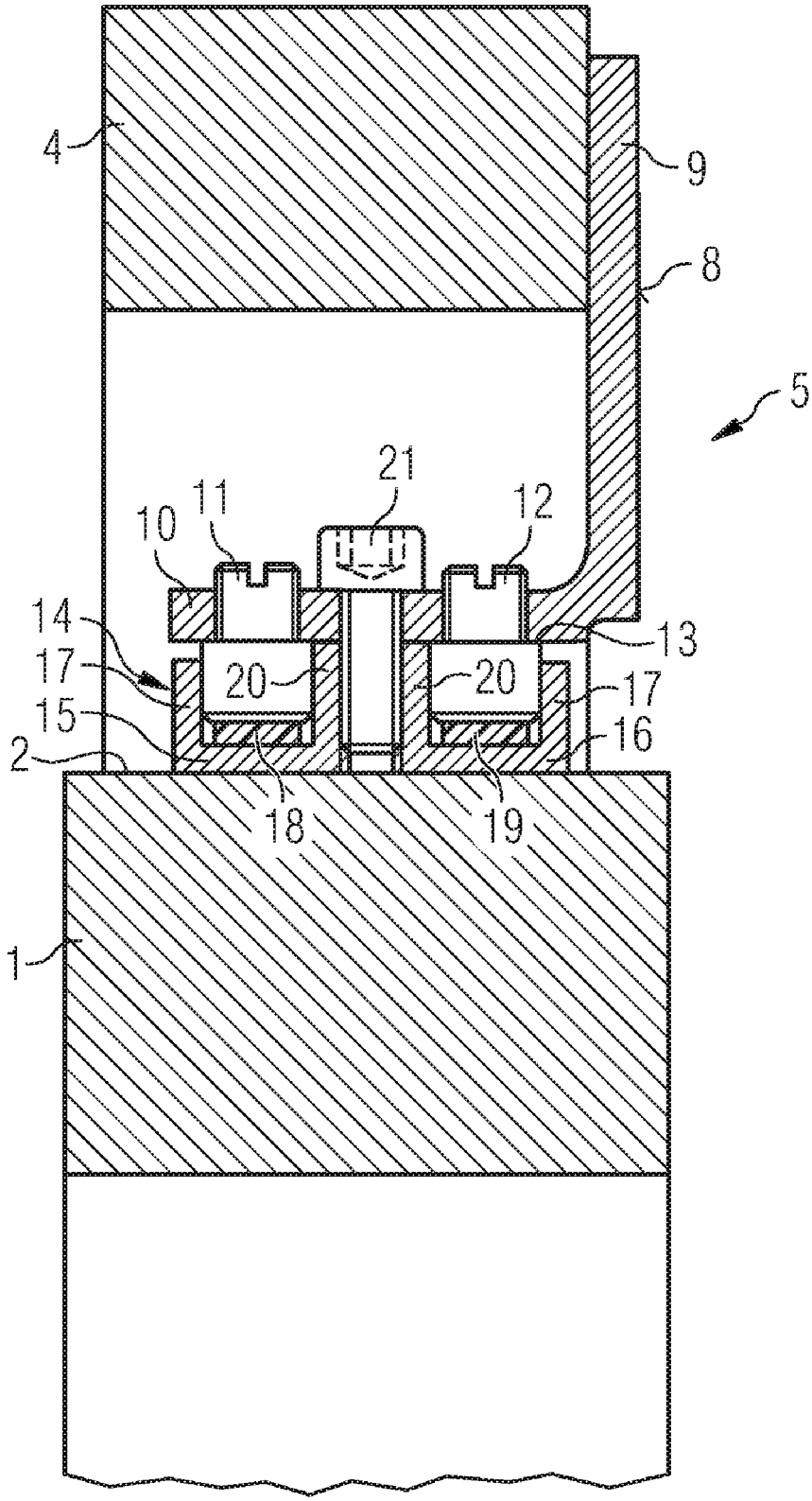
FIG. 2 shows a detail cross section A-A of FIG. 1.

FIGS. 1 and 2 show an axial compressor casing 1 comprising a unison ring assembly 3 arranged concentrically around a slide face of the outer surface of the compressor casing 1. The unison ring assembly 3 comprises a unison ring 4 and three unison ring supports 5, 6, 7 being radial inwardly and equally spaced arranged along the circumference of the unison ring 4. Each unison ring support 5, 6, 7 comprises an unison ring bracket 8, wherein the unison ring bracket 8 is formed by a unison ring bracket fixation leg 9 and a unison ring bracket slide leg 10, together forming a L-form of the unison ring bracket 8.

Further, each unison ring support 5, 6, 7 comprises a slide bearing 14 for sliding along a slide face 2 of the outer surface of the compressor casing, and a resilient member being arranged between and coupled to the slide bearing 14 and the unison ring bracket sliding leg 10, such that the unison ring 4 is rotatable around the compressor casing 1 by sliding the slide bearing 14 along the slide face 2. The unison ring bracket fixation leg 9 is attached to the unison ring 4 for carrying the unison ring 4 on the compressor casing 1.

The resilient member comprises two slide pins 11, 12 and between each slide pin 11, 12 an elastic member 18, 19. The slide pins 11, 12 are arranged side by side in axial direction of the unison ring 4. Each slide pin 11, 12 has an outer end supported at the unison bracket slide bracket leg 10 and an inner end extending radial towards the centre of the unison ring 4. The elastic element 18, 19 forces the inner end of the slide pin 11, 12 and the slide bearing 14.

The outer end of the slide pin 11, 12 has a smaller diameter than the inner end of the slide pin 11, 12. Thereby a stop is formed, wherein the outer end is fitted into a hole provided in the unison ring bracket slide leg 10. The stop 13 abuts against the unison rig bracket 8.

Furthermore, the slide bearing 14 comprises a first collar and a second collar 17, wherein the inner end of the first slide pin 11 and the first elastic element 18 are embedded by the first collar, and the inner end of the second slide pin 12 and the second elastic element 19 are embedded by the second collar 17.

The slide bearing 14 comprises a web 20 which is arranged between the first slide pin 11 and the second slide pin 12. A threaded hole in provided in the web 20 and a through hole being in line to the threaded hole is provided in the unison ring bracket slide leg 10. A compression screw 21 is inserted into both holes thereby forming a bolted connection between the unison ring bracket slide leg 10 and the slide bearing 14. When the compression screw 21 is tightened, the web 20 is screwed to the unison ring bracket slide leg 10. Further, when the compression screw 21 is loosened, the web 20 is lifted off the unison ring bracket slide leg 10 thereby expanding the elastic elements 18, 19.

The invention claimed is:

1. A unison ring assembly for an axial compressor casing, comprising:

a unison ring;

at least three unison ring supports equally spaced arranged along a circumference of the unison ring, wherein each unison ring support comprises a unison ring bracket fixed to the unison ring;

a slide bearing to be sliding along a slide face of an outer surface of the compressor casing;

a resilient member being arranged between and coupled to the slide bearing and the unison ring bracket such that the unison ring is rotatable around the compressor casing by sliding the slide bearing along the slide face and to be centered free of clearance about the compressor casing; and a raising device adapted to raise the slide bearing towards the unison ring bracket thereby compressing the resilient member, wherein each resilient member is adapted to accommodate radial displacement of the compressor casing, wherein each resilient member comprises at least one slide pin with a first end supported at the unison ring bracket of the respective unison ring support and a second end extending in a radial direction towards a centre of the unison ring together with an elastic element, the elastic element being arranged between the second end of the slide pin and the slide bearing.

2. The unison ring assembly according to claim 1, wherein each slide bearing is profiled to match an outer diameter of the compressor casing.

3. The unison ring assembly according to claim 1, wherein the first end of the slide pin has a smaller diameter than the second end of the slide pin thereby forming a stop, and wherein the first end is fitted into a hole provided in the unison ring bracket of the respective unison ring support such that the stop abuts against the unison ring bracket.

4. The unison ring assembly according to claim 1, wherein each resilient member comprises a first and second slide pin, the first slide pin being arranged together with a first elastic member and the second slide pin being arranged together with a second elastic member, and wherein the slide pins are arranged side by side in axial direction of the unison ring.

5. The unison ring assembly according to claim 3, wherein each resilient member comprises a first and second slide pin, the first slide pin being arranged together with a first elastic member and the second slide pin being arranged together with a second elastic member, and wherein the slide pins are arranged side by side in axial direction of the unison ring.

6. The unison ring assembly according to claim 4, wherein each slide bearing comprises a first collar and a second collar, wherein a second end of the first slide pin and the first elastic element are embedded by the first collar, and a second end of the second slide pin and the second elastic element are embedded by the second collar.

7. The unison ring assembly according to claim 5, wherein each slide bearing comprises a first collar and a second collar, wherein a second end of the first slide pin and the first elastic element are embedded by the first collar, and a second end of the second slide pin and the second elastic element are embedded by the second collar.

8. The unison ring assembly according to claim 1, wherein each raising device comprises a web of the slide bearing being arranged between a first slide pin and a second slide pin, and a compression screw forming a bolted connection between the unison ring bracket and the slide bearing adapted to fix the slide bearing to the unison ring bracket as well as to lift off the slide bearing from the unison ring bracket.

9. An axial compressor, comprising:

a casing; and a unison ring assembly, comprising:

a unison ring;

at least three unison ring supports equally spaced arranged along a circumference of the unison ring, wherein each unison ring support comprises a unison ring bracket fixed to the unison ring;

a slide bearing to be sliding along a slide face of an outer surface of the compressor casing;

a resilient member being arranged between and coupled to the slide bearing and the unison ring bracket such that the unison ring is rotatable around the compressor casing by sliding the slide bearing along the slide face and to be centered free of clearance about the compressor casing;

a raising device adapted to raise the slide bearing towards the unison ring bracket thereby compressing the resilient member wherein each resilient member is adapted to accommodate radial displacement of the compressor casing, wherein each resilient member comprises at least one slide pin with a first end supported at the unison ring bracket of the respective unison ring support and a second end extending in a radial direction towards a centre of the unison ring together with an elastic element, the elastic element being arranged between the second end of the slide pin and the slide bearing.

10. The axial compressor according to claim 9, wherein each slide bearing is profiled to match an outer diameter of the compressor casing.

11. The axial compressor according to claim 9, wherein the first end of the slide pin has a smaller diameter than the second end of the slide pin thereby forming a stop, and wherein the first end is fitted into a hole provided in the unison ring bracket of the respective unison ring support such that the stop abuts against the unison ring bracket.

12. The axial compressor according to claim 9, wherein each resilient member comprises a first and second slide pin, the first slide pin being arranged together with a first elastic member and the second slide pin being arranged together with a second elastic member, and wherein the slide pins are arranged side by side in axial direction of the unison ring.

13. The axial compressor according to claim 12, wherein each slide bearing comprises a first collar and a second collar, wherein a second end of the first slide pin and the first elastic element are embedded by the first collar, and a second end of the second slide pin and the second elastic element are embedded by the second collar.

14. The axial compressor according to claim 9, wherein each raising device comprises a web of the slide bearing being arranged between a first slide pin and a second slide pin, and a compression screw forming a bolted connection between the unison ring bracket and the slide bearing adapted to fix the slide bearing to the unison ring bracket as well as to lift off the slide bearing from the unison ring bracket.

15. A method for mounting a unison ring assembly on an axial compressor casing, comprising:

providing a unison ring assembly separate from an axial compressor casing with a slide face of an outer surface of the compressor casing, the unison ring assembly including a unison ring, at least three unison ring supports equally spaced arranged along a circumference of the unison ring, wherein each unison ring support comprises a unison ring bracket fixed to the unison ring, a slide bearing to be sliding along a slide face of an outer surface of the compressor casing, a resilient member being arranged between and coupled to the slide bearing and the unison ring bracket such that the unison ring is rotatable around the compressor casing by sliding the slide bearing along the slide face and to be centered free of clearance about the compressor casing, a raising device adapted to raise the slide bearing towards the unison ring bracket thereby compressing the resilient member, wherein each resilient member is adapted to accommodate radial displacement of the compressor casing, and wherein each resilient member comprises at least one slide pin with a first end supported at the unison ring bracket of the respective unison ring support and a second end extending in a radial direction towards a centre of the unison ring together with an elastic element, the elastic element being arranged between the second end of the slide pin and the slide bearing;

simultaneously compressing the resilient members of each unison ring support by actuating the raising devices such that the slide bearings of each unison ring support define an inner diameter being at least equal or grater than the outer diameter of the slide face;

shifting the unison ring assembly in an axial direction of the compressor casing over the slide face; and releasing the resilient members of each unison ring support by actuating the raising devices such that the slide bearings abut on the slide face.

* * * * *